US011473179B2

(12) United States Patent
Shi et al.

(10) Patent No.: US 11,473,179 B2
(45) Date of Patent: Oct. 18, 2022

(54) METHOD FOR PREPARING HIGH-STRENGTH, DISSOLVABLE MAGNESIUM ALLOY MATERIAL

(71) Applicants: FUJIAN MEIFU TECHNOLOGY CO., LTD., Fujian Province (CN); Shanghai Gebang Automation Co., Ltd., Shanghai (CN)

(72) Inventors: Zhigang Shi, Longyan (CN); Shenghao Liu, Longyan (CN); Xiangtao Meng, Longyan (CN)

(73) Assignees: FUJIAN MEIFU TECHNOLOGY CO., LTD., Fujian (CN); SHANGHAI GEBANG AUTOMATION CO., LTD., Shanghai (CN)

( * ) Notice: Subject to any disclaimer, the term of this patent is extended or adjusted under 35 U.S.C. 154(b) by 230 days.

(21) Appl. No.: 16/756,854

(22) PCT Filed: Nov. 29, 2019

(86) PCT No.: PCT/CN2019/122014
§ 371 (c)(1),
(2) Date: Apr. 17, 2020

(87) PCT Pub. No.: WO2021/102922
PCT Pub. Date: Jun. 3, 2021

(65) Prior Publication Data

US 2021/0404041 A1 Dec. 30, 2021

(51) Int. Cl.

| | |
|---|---|
| ***C22F 1/06*** | (2006.01) |
| ***C22C 1/02*** | (2006.01) |
| ***C22C 23/00*** | (2006.01) |
| *E21B 33/134* | (2006.01) |

(52) U.S. Cl.
CPC ..... *C22F 1/06* (2013.01); *C22C 1/02* (2013.01); *C22C 23/00* (2013.01); *E21B 33/134* (2013.01); *E21B 2200/08* (2020.05)

(58) Field of Classification Search
CPC ... C22F 1/06; C22C 1/02; C22C 23/00; E21B 33/134; E21B 2200/08; E21B 43/26
See application file for complete search history.

(56) References Cited

U.S. PATENT DOCUMENTS

| | | | | |
|---|---|---|---|---|
| 2018/0214940 | A1* | 8/2018 | Duguid | C22C 23/00 |
| 2019/0048448 | A1* | 2/2019 | Doud | C22C 23/02 |
| 2021/0040593 | A1* | 2/2021 | Wang | C22C 1/02 |

FOREIGN PATENT DOCUMENTS

| | | | | |
|---|---|---|---|---|
| CN | 107739858 A | * | 2/2018 | C22C 1/02 |

* cited by examiner

*Primary Examiner* — John A Hevey
(74) *Attorney, Agent, or Firm* — Leong C. Lei

(57) ABSTRACT

A method for preparing a high-strength, dissolvable magnesium alloy material includes steps of: (1) preparing a magnesium-nickel intermediate alloy, which is Mg25Ni or Mg30Ni; (2) loading; (3) heating, melting and alloying; and (4) refining adequately alloyed magnesium melt at 750±20° C. for about 5 minutes while using RJ-6 as a refining flux and setting the melt still for about 10 minutes. The method allows easy addition of nickel as a component to a magnesium alloy during smelting such that nickel is evenly distributed throughout the magnesium alloy.

4 Claims, No Drawings

METHOD FOR PREPARING HIGH-STRENGTH, DISSOLVABLE MAGNESIUM ALLOY MATERIAL

BACKGROUND OF THE INVENTION

1. Technical Field

The present invention relates to a method for preparing a high-strength, dissolvable magnesium alloy material.

2. Description of Related Art

The tendency of petroleum exploration is increasingly toward low-permeability, low-grade resources, making sectional fracturing technology for horizontal wells an important means to reservoir reformation and increase in production per well. As a major tool for sectional fracturing, bridge plugs have been extensively used. The purpose of bridge plugs is for blocking oil and gas wells. This requires good tensile strength and ductility form bridge plugs. In the event that subsequent works have to be done in a blocked oil and gas well, the conventional solution involves having a well-trained operator use special equipment to drill through the bridge plug. However, the related operation is rather complicated and inconvenient. Besides, the incidentally generated debris and waste liquid can pollute the reservoir. For addressing this issue, dissolvable bridge plugs have been developed, yet the existing dissolvable bridge plugs made of magnesium alloys are not satisfying in terms of tensile strength and ductility and they have problems with uneven dissolution.

Technical Issues

The objective of the present invention is to provide a method for preparing a high-strength, dissolvable magnesium alloy material that overcomes the foregoing shortcomings.

According to our extensive experiments and researches, it is found that the existing bridge plug materials tend to dissolve unevenly because of the addition of nickel. To state specifically, with a well-designed composition of nickel and other alloy components in a high-strength, dissolvable magnesium alloy material, the resulting bridge plug as a well completion tool can have a desired dissolution rate under certain conditions. Nickel has a melting point of 1455° C. and a density of 8.9 g/cm$^3$, while magnesium has a melting point of 648.8° C. and a density of 1.748.9 g/cm$^3$, but its boiling point is only 1107° C. In contrast with the high melting point and density of nickel, the furnace temperature for magnesium alloys is normally up to 800° C. Thus, during smelting of a magnesium alloy material, it is difficult to add metallic nickel directly into magnesium melt. Since metallic nickel melts slowly and its density is more than five times higher that magnesium, when added into magnesium melt, it can soon precipitate at the bottom of the crucible and this prevents proper formation of an Mg2Ni alloy. A bridge plug using such a poorly smelted alloy may have problem to provide even dissolution within a desired period of time, and can become an obstruction to subsequent construction.

SUMMARY OF THE INVENTION

Technical Solution

In order to address the foregoing issue about smelting, we have developed and produced two magnesium-nickel intermediate alloys. They are (1) Mg25Ni, having a Ni content of 23-27%; and (2) Mg30Ni, having a Ni content of 27-32%. The two magnesium nickel intermediate alloys are close to a magnesium-nickel eutectic structure and have the MgNi phase, making them have low melting points that facilitate their addition during smelting of magnesium alloy products. By incorporating other intermediate alloys, the resulting magnesium alloy can have good tensile strength and ductility.

The present invention implements the following technical schemes:

A method for preparing a high-strength, dissolvable magnesium alloy material, comprising the following steps:

(1) preparing a magnesium-nickel intermediate alloy, which is Mg25Ni or Mg30Ni.

(1-1) loading: powering on an intermediate frequency furnace or a line frequency furnace, heating a crucible slowly to dark red; loading a nickel material around the crucible and loading magnesium ingots in the crucible, keeping heating the furnace to melt the magnesium ingots and the nickel material and then stirring.

(1-2) after the loading step, starting to heat and melt the magnesium-nickel intermediate alloy at a smelting temperature of 920° C., while controlling a nickel content to a range between 23% and 35%.

(1-3) when about two thirds of the metallic nickel has been melted, reducing heating power, and continuously stirring resulting Mg—Ni alloy melt, while closely watching variations of a temperature of the alloy melt, when the temperature of the melt becomes 860° C., powering off heating, allowing the temperature of the alloy melt to increase in a controlled manner; and when the temperature of the melt becomes about 900° C., adding a prepared cooling material as needed, until the metallic nickel has been completely melted into the magnesium melt.

(1-4) when the temperature of the alloy melt becomes stable and stops increasing, and when there is no more unmelted solid left in the crucible as perceived during stirring, gradually adding the remaining cooling material; adjusting a pouring temperature to 680-760° C., pouring the melt into an ingot mold in an ingot-casting machine, and cooling resulting ingots for later use.

(2) preparing raw magnesium ingots, zinc ingots, an Mg30Gd intermediate alloy, an Mg30Y intermediate alloy, an Mg30Zr intermediate alloy, an Mg30Cu intermediate alloy, and the Mg30Ni intermediate alloy; and after the crucible is preheated to dark red (about 500° C.), loading the materials in an order as stated above;

(3) heating, melting and alloying;

(3-1) after the loading step, starting to heat and melt the magnesium-nickel intermediate alloy, until the material in the crucible has been completely melted, when the melt temperature reaches 700±20° C., agitating the alloy melt adequately using argon gas, and adding a proper amount of an RJ-5 flux, reacting 10-15 minutes and leaving the melt still for 15-20 minutes; sampling for first bath analysis, and removing slag from the bottom of the crucible;

(3-2) with reference to results from the first bath analysis and total counts of feeding material, formulating and adding alloy components Zn, Gd, Y, Cu, Ni, and Zr; wherein except for Zn that is added in the form of metallic zinc directly, all the alloy components are added in the form of alloys, namely the Mg30Gd intermediate alloy, the Mg30Y intermediate alloy, the Mg30Zr intermediate alloy, the Mg30Cu intermediate alloy, and the Mg30Ni intermediate alloy; and before addition, preheating all the intermediate alloys to 250-300° C.;

(4) refining; refining the adequately alloyed magnesium melt at 750±20° C. for about 5 minutes while using RJ-6 as a refining flux and setting the melt aside for about 10 minutes;

(5) setting still; after the refining step, cleaning slag around the crucible and slag over the liquid magnesium melt, and applying a covering agent;

(6) pouring; using low-pressure injection and electromagnetic stirring crystallizer for forming; and (7) performing homogenization heat treatment on cast rods and then performing extrusion molding;

wherein the prepared magnesium alloy has a tensile strength of 409 MP and a dissolution rate of 52.63-58.16 $mg/cm^2/hr$.

Preferably, Step (1-1) loading comprises: removing moisture from nickel powder by means of baking, powering on the intermediate frequency furnace or the line frequency furnace, heating a crucible slowly to dark red, putting the magnesium ingots into the crucible, using the intermediate frequency furnace or the line frequency furnace to continuously heat the crucible until the magnesium ingots are melted, and adding nickel powder slowly with stirring when the temperature of the magnesium melt has reached 700° C.

Preferably, the cooling material for Step (1-3) is magnesium ingots.

Preferably, in Step (3-2), the materials are added in an order of: Zn, Mg30Cu, Mg30Gd, Mg30Ni, Mg30Y, and Mg30Zr; and the materials are added at temperatures of: 720-740° C. for Zn; 720-740° C. for Mg30Cu; 720-740° C. for Mg30Gd; 740-760° C. for Mg30Ni; 740-760° C. for Mg30Y; and 780-800° C. for Mg30Zr.

Beneficial Effects

The present invention has the following beneficial effects. The method of the present invention overcomes the challenge of adding nickel into magnesium alloy products during smelting and makes nickel evenly distribute throughout a magnesium alloy. The even distribution of nickel in turn ensures even dissolution of the resulting magnesium alloy. Additionally, with addition of other metals, the disclosed invention endows the resulting magnesium alloy with improved tensile strength and ductility as compared to the conventional magnesium alloy products. Furthermore, bridge plugs made of the magnesium alloy as disclosed herein provides good tensile strength and sealing effects when used in blocking oil and gas wells. The magnesium alloy allows such bridge plugs to be evenly dissolved when exposed to a solution specially designed for this purpose. Regardless of the geologic conditions, such as the temperature and mineralization degree, the resulting bridge plugs can dissolve within a desired period of time.

DETAILED DESCRIPTION OF THE INVENTION

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

A method for preparing a high-strength, dissolvable magnesium alloy material comprises the following steps.

Step 1 is about preparing a magnesium-nickel intermediate alloy, which is Mg25Ni or Mg30Ni.

Step 1.1 is loading, which involves powering on an intermediate frequency furnace or a line frequency furnace, and heating a crucible slowly to dark red. In an embodiment where nickel plates are used, the nickel plates are preheated. In an embodiment where nickel powder is used, moisture has to be removed from the nickel powder by means of baking. The heated or unheated nickel plates are filled around a crucible, and magnesium ingots are put into the crucible. Ni and Mg can be mixed and then loaded into an intermediate frequency furnace or a line frequency furnace for facilitating fast melting of the nickel plates. In an embodiment where nickel powder is used, the raw magnesium ingots are loaded first, and after the magnesium ingots have been completely melted, and the nickel powder are added slowly with stirring when the temperature of the magnesium melt has reached 700° C.

Step 1.2 follows the loading step and involves starting to heat and melt the magnesium-nickel intermediate alloy. Since metallic nickel has a high melting point, its melting needs a large amount of heat. On the other hand, magnesium has a low melting point, so its melting occurs faster than nickel when the two are placed into the crucible simultaneously. At this point, Ni undergoes a relatively long endothermic process before mixing with the magnesium melt to form the desired alloy texture. According to the alloy phase diagram theory, the atomic structure theory and the thermodynamics theory, an Mg—Ni system has two eutectic invariant transformations, at 512° C. and 1082° C., respectively, and a peritectic invariant transformation at 768° C. The solid-liquid incongruent melting properties of the compound Mg2Ni at 768° C. are also determined. As the boiling point of magnesium is 1090° C., it is desired that the magnesium-nickel intermediate alloy is smelted at a moderate temperature, which is up to 920° C., with the nickel content typically controlled at 35% or less for easy addition in the subsequent alloying process.

In Step 1.3, when magnesium has been completely melted, the nickel plates in the crucible have absorbed a large amount of heat and start to melt. At this time, proper agitation of the magnesium melt can make the nickel plates melt faster. As the nickel plates absorb heat and get melted, an MgNi phase (I≈Mg+Mg2Ni) is formed in the Mg—Ni alloy melt gradually, and a large amount of heat is released to continuously increase the temperature of the alloy melt, which in turn increases the melting rate of metallic nickel in the magnesium melt. When more than two thirds of metallic nickel has been melted, it is time to power off heating or to reduce heating power. Then the Mg—Ni alloy melt is continuously stirred with variations of the temperature of the alloy melt watched closely. When the melt temperature reaches about 860° C., it is time to power off heating and to allow the temperature of the alloy melt to increase in a controlled manner. When the temperature of the melt becomes about 900° C., a prepared cooling material (magnesium ingots) is optionally added to prevent the melt temperature from keeping going up. It is to be noted that the cooling material should be added moderately because the desired Mg2Ni phase texture is difficult to form if the alloy melt is too cold. The alloy melt has to be stirred continuously throughput the process until the metallic nickel has been completely melted into the magnesium melt and the texture of the magnesium nickel intermediate alloy is evenly alloyed to minimize segregation. Temperature control is crucial in the melting process of the Mg—Ni intermediate alloy. In particularly, metallic nickel absorbs a large amount of heat and gets melted and mixed with the magnesium melt to form the Mg2Ni phase. Then during formation of the Mg2Ni texture, a large amount of heat is released to make the temperature of the alloy melt increase sharply. Thus it is important to reserve some magnesium ingots as the cooling material before loading for preventing the temperature of the alloy melt from increasing abruptly.

In Step 1.4, when the temperature of the alloy melt becomes stable and stops increasing, and when there is no more unmelted solid left in the crucible as perceived during stirring, the remaining cooling material is added gradually. At this time, the pouring temperature is controlled at 680-760° C. because the mobility can be reduced if the temperature is too low yet a too high pouring temperature can lead to excessive gas absorption of the alloy melt, which is unfavorable to subsequent pouring molding. Then the melt is poured into an ingot mold in an ingot-casting machine for form ingots which are cooled for later use.

Step 2 involves preparing raw magnesium ingots, zinc ingots, an Mg30Gd intermediate alloy, an Mg30Y intermediate alloy, an Mg30Zr intermediate alloy, an Mg30Cu intermediate alloy, and the Mg30Ni intermediate alloy; and after the crucible is preheated to dark red (about 500° C.), loading the materials in an order as stated above. Before loading, proper amount of a flux is applied at the bottom of the crucible and around the crucible apply. Large pieces of foundry returns and magnesium ingots are loaded at the upper part in a way that no bridging is formed. While the materials are loaded, a proper amount of flux is applied. If the materials are too much to be loaded in the initial loading, the remaining may be added during the heating and melting process gradually.

Step 3 is about heating and melting and alloying, and includes the following steps.

Step 3.1 is performed after the loading step, and involves starting to heat and melt the magnesium-nickel intermediate alloy, until the material in the crucible has been completely melted, when the melt temperature reaches 700±20° C., agitating the alloy melt adequately using argon gas, and adding a proper amount of an RI-5 flux, which is for preventing the magnesium liquid from firing and facilitating the first refining of the alloy melt, reacting 10-15 minutes and leaving the melt still for 15-20 minutes; sampling for first bath analysis, and removing slag from the bottom of the crucible.

Step 3.2 involves, with reference to results from the first bath analysis and total counts of feeding material, formulating and adding alloy components Zn, Gd, Y, Cu, Ni, and Zr, wherein except for Zn that is added in the form of metallic zinc directly, all the alloy components are added in the form of alloys, namely an Mg30Gd intermediate alloy, an Mg30Y intermediate alloy, an Mg30Zr intermediate alloy, an Mg30Cu intermediate alloy, and an Mg30Ni intermediate alloy. The order of addition is: Zn, Mg30Cu, Mg30Gd, Mg30Ni, Mg30Y, and Mg30Zr. The materials are added at temperatures of: 720-740° C. for Zn; 720-740° C. for Mg30Cu; 720-740° C. for Mg30Gd; 740-760° C. for Mg30Ni; 740-760° C. for Mg30Y; 780-800° C. for Mg30Zr. Before addition, all the alloy components are preheated to 250-300° C. The addition has to be performed slowly with stirring. During the addition of the alloy components, a proper amount of RJ-5 may be used to prevent the magnesium liquid from firing. After each alloy component is added, the melt is stirred for 5 minutes before another alloy component is added. After all the alloy components have been added, the melt is stirred for additional 10-15 minutes to allow adequate alloying. Then the temperature of the alloy melt is adjusted to 750±20° C. as a preparation for refining.

Step 4 is to refine the adequately alloyed magnesium melt at 750±20° C. The refining is performed using RJ-6 as the flux. It is important to stir the magnesium alloy melt thoroughly without any dead space. Furthermore, a proper amount of a refining agent is applied at the wave crest and the stirring is so performed that the magnesium liquid is not splashed. The refining is performed for about 5 minutes and the melt is set still for about 10 minutes before sampling for second bath analysis. If the results of the analysis show that the requirements for the designation chemical composition is not satisfied, the additional alloy components are added until the requirements are satisfied. If the requirements are not met after three additional additions of alloy components, the melt is poured and re-melted. If the melt is determined in the analysis as of the middle level with respect to the designation chemical composition requirements of the target alloy, the components reduce during cooling and pouring are qualified if they are of middle or high levels. The refining proceeds for 15-20 minutes to ensued the alloy melt varies stably during refining. If the magnesium melt when turned upside down becomes mirror polishing, it indicates that the refining is qualified.

In Step 5, after the refining step, slag around the crucible and slag over the liquid magnesium melt are cleaned and a covering agent is applied. The alloy melt temperature is set at 750±20° C. and held for 20 minutes, before decreased to 730±20° C. and held for another period of 40-60 minutes. Then bath analysis is performed on an on-the-spot sample. In the event of failure in qualification tests, slag is first removed from the bottom of the crucible and then the steps of additional addition of the alloy components, alloying and refining are repeated as described above. If the results of the test are satisfying, the alloy melt is adjusted to the pouring temperature of 710±20° C. of the subsequent pouring step.

Step 6 is about pouring, which includes using low-pressure injection and electromagnetic stirring crystallizer for forming. Process parameters for pouring such as the alloy melt temperature, pouring speed, water-cooling intensity, and dispensing funnel are reasonably controlled to prevent the resulting cast rods from hot cracking, cold shot or other undesired defects.

Step 7. performing homogenization heat treatment on cast rods and then performing extrusion molding. The cast rod when solidified rapidly undergoes component segregation and shrinkage stress. It is thus desired to eliminate regional component segregation and internal stress inside the cast rod for higher processability in subsequent handling. To this end, homogenization heat treatment is performed on the cast rod for 16 hours at 410±20° C. Then the furnace is open for leaving the cast rod in furnace cooling for 30 minutes. Afterward, the cast rod is removed from the furnace chamber for air cooling. Finally, the equipment and the rod are heated in stages following the conventional extrusion process requirements.

The magnesium alloy materials so produced contain Cu: 0.5-2.5% by weight, Ni: 0.5-1.5% by weight, Gd: 8.0-10.0% by weight, Y 2.0-4.0% by weight, and Zn: 0.5-2.0% by weight.

The specimens of the magnesium alloy material so produced have tensile strength properties as detailed in the table below:

| Unit | Specimen No. | Specimen Serial No. | Tensile Strength Rm MPa | Rp0.2 MPa | Elongation after Fracture A % |
|---|---|---|---|---|---|
| Specimen 1 | 1-1 | φ93-1 | 397.8558 | 336.1346 | 4.56 |
| Specimen 2 | 1-2 | φ93-2 | 409.3806 | 327.7214 | 5.40 |
| Specimen 3 | 1-3 | φ93-3 | 405.0152 | 322.1891 | 5.60 |

The specimens of the magnesium alloy material so produced have dissolution rates ranging between 52.63 and 58.16 mg/cm$^2$/hr, as detailed in the table below:

Dissolution Rate Test

| Start Time | End Time | Time Elapsed | Height (mm) | Diameter (mm) | Weight (g) | Weight Loss (g) | temperature (° C.) | Concentration | Dissolution Rate (mg/cm$^2$/hr) |
|---|---|---|---|---|---|---|---|---|---|
| | | | 12.7 | 50.78 | 50.84 | | | | |
| 9:05 | 10:05 | 1 | 12.7 | 50.78 | 49.67 | 1.17 | 93 | 3% KCL 14600 ppm | 19.25 |
| 10:07 | 11:07 | 2 | 12.66 | 50.56 | 46.53 | 3.144 | 93 | 3% KCL 14600 ppm | 51.74 |
| 11:09 | 12:09 | 3 | 12.44 | 49.64 | 43.02 | 3.505 | 93 | 3% KCL 14600 ppm | 58.16 |
| 12:11 | 13:41 | 4.5 | 11.68 | 48.32 | 38.27 | 4.758 | 93 | 3% KCL 14600 ppm | 54.59 |
| 13:43 | 15:43 | 6.5 | 10.86 | 46.96 | 32.54 | 5.727 | 93 | 3% KCL 14600 ppm | 52.63 |

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A method for preparing a high-strength, dissolvable magnesium alloy material, comprising steps of:

(1) preparing a magnesium-nickel intermediate alloy, which is Mg30Ni;

(1-1) loading: powering on an intermediate frequency furnace or a line frequency furnace, heating a crucible to about 500° C.; loading a nickel material around the crucible and loading magnesium ingots in the crucible, reserving a portion of the magnesium ingots to be a prepared cooling material, keeping heating the furnace to melt the magnesium ingots and the nickel material and then stirring;

(1-2) after the loading step, starting to heat and melt the magnesium-nickel intermediate alloy at a smelting temperature of 920° C., while controlling a nickel content to a range between 23% and 35%;

(1-3) when about two thirds of the nickel material has been melted, reducing heating power, and continuously stirring resulting a Mg—Ni alloy melt; when the temperature of the Mg—Ni alloy melt becomes 860° C., powering off heating, allowing the temperature of the Mg—Ni alloy melt to increase in a controlled manner; and when the temperature of the Mg—Ni alloy melt becomes about 900° C., adding the prepared cooling material as needed, until the nickel material has been completely melted into the Mg—Ni alloy melt;

(1-4) when the temperature of the Mg—Ni alloy melt becomes stable and stops increasing, and when there is no more unmelted solid left in the crucible as perceived during stirring the Mg—Ni alloy melt, gradually adding remaining portion of the prepared cooling material; adjusting a pouring temperature to 680-760° C., pouring the Mg—Ni alloy melt into an ingot mold in an ingot-casting machine, and cooling resulting ingots for later use;

(2) preparing raw magnesium ingots, zinc ingots, an Mg30Gd intermediate alloy, an Mg30Y intermediate alloy, an Mg30Zr intermediate alloy, an Mg30Cu intermediate alloy, and the Mg30Ni intermediate alloy; and after the crucible is preheated to about 500° C., loading the raw magnesium ingots, the zinc ingots, the Mg30Gd intermediate alloy, the Mg30Y intermediate alloy, the Mg30Zr intermediate alloy, the Mg30Cu intermediate alloy, and the Mg30Ni intermediate alloy in an order;

(3) heating, melting and alloying;

(3-1) after the loading step, starting to heat and melt the magnesium-nickel intermediate alloy, until the material in the crucible has been completely melted, when the melt temperature reaches 700±20° C., agitating the alloy melt adequately using argon gas, and adding a proper amount of an RJ-5 flux, reacting 10-15 minutes and leaving the melt still for 15-20 minutes; sampling for first bath analysis, and removing slag from the bottom of the crucible;

(3-2) with reference to results from the first bath analysis and total counts of feeding material, formulating and adding alloy components Zn, Gd, Y, Cu, Ni, and Zr; wherein except for Zn that is added in the form of metallic zinc directly, all the alloy components are added in the form of alloys, namely the Mg30Gd intermediate alloy, the Mg30Y intermediate alloy, the Mg30Zr intermediate alloy, the Mg30Cu intermediate alloy, and the Mg30Ni intermediate alloy; and before addition, preheating all the intermediate alloys to 250-300° C.;

(4) refining; refining the alloyed magnesium melt at 750±20° C. for about 5 minutes while using RJ-6 as a refining flux and performing no additional steps for about 10 minutes;

(5) setting still; after the refining step, cleaning slag around the crucible and slag over the liquid magnesium melt, and applying a covering agent;

(6) pouring; using low-pressure injection and electromagnetic stirring crystallizer for forming; and (7) performing homogenization heat treatment on castings obtained in step (6) and then performing extrusion molding;

wherein the prepared magnesium alloy has a tensile strength of 409 MPa and a dissolution rate of 52.63-58.16 mg/cm$^2$/hr.

2. The method of claim 1, wherein Step (1-1) loading comprises removing moisture from nickel powder by means of baking, powering on the intermediate frequency furnace or the line frequency furnace, heating the crucible slowly to dark red, putting the magnesium ingots into the crucible, using the intermediate frequency furnace or the line frequency furnace to continuously heat the crucible until the magnesium ingots are melted, and adding nickel powder slowly with stirring when the temperature of the magnesium melt has reached 700° C.

3. The method of claim 1, wherein the cooling material for Step (1-3) is magnesium ingots.

4. The method of claim 1, wherein in Step (3-2), the materials are added in an order of: Zn, Mg30Cu, Mg30Gd, Mg30Ni, Mg30Y, and Mg30Zr; and the materials are added at temperatures of: 720-740° C. for Zn; 720-740° C. for Mg30Cu; 720-740° C. for Mg30Gd; 740-760° C. for Mg30Ni; 740-760° C. for Mg30Y; and 780-800° C. for Mg30Zr.

* * * * *